United States Patent [19]

Burvall

[11] 4,076,431

[45] Feb. 28, 1978

[54] CONNECTING ELEMENT

[76] Inventor: Sten Burvall, 7, Hjartervagen, S-142 00, Trangsund, Sweden

[21] Appl. No.: 712,998

[22] Filed: Aug. 9, 1976

[51] Int. Cl.[2] ..... F16B 7/00

[52] U.S. Cl. ..... 403/171; 403/231; 403/406

[58] Field of Search ..... 403/171, 205, 176, 217, 403/218, 219, 172, 231, 403, 406

[56] References Cited

U.S. PATENT DOCUMENTS 3,740,084 6/1973 Tellberg ..... 403/171

*Primary Examiner*—Wayne L. Shedd

*Attorney, Agent, or Firm*—Pollock, VandeSande & Priddy

[57] ABSTRACT

This invention relates to universal connecting elements for removably joining together frame members such as posts, braces, stays or the like. The same connecting element is used at all corners and/or main points of the frame structure, and consists of two open-ended sleeves oriented at 120° to one another, and a third sleeve open at both ends thereof which extends in one direction only from a plane defined by the forwardmost faces of the two sleeves, the third sleeve being oriented at 90° to said plane.

5 Claims, 3 Drawing Figures

CONNECTING ELEMENT

The present invention relates to connecting elements for removably joining together such frame members as posts, braces, stays or the like.

BACKGROUND OF THE INVENTION

The connecting elements of the present invention can be used, for example, in the construction of frames for supporting awnings, tarpaulins and like covers under which boats, cars etc., can be housed in the winter months or which can be used as temporary storage facilities, green houses or hot houses. The advantage afforded by such connecting elements is that they enable the frame structures to be readily assembled and dismantled at a relatively low investment cost.

A number of such frame structures are known which comprise a plurality of wooden frame-members nailed together. The manufacture of these frame-members, however, is time consuming, and they are difficult to assemble. When dismantling such frame structures, the wooden frame-members often become damaged, rendering them unservicable for further use. Other known frame structures comprise tubular frame-members, but these are expensive and heavy to handle when assembling and dismantling the frame. Furthermore, such tubular frame structures are relatively complicated, since they comprise a larger number of differently shaped elements.

A known connecting element, described in Swedish Pat. No. 340,160 (corresponding to Tellberg U.S. Pat. No. 3,740,084), comprises sleeves which are intended to receive frame members or the like. This known connecting element is encumbered with a number of disadvantages, however. One disadvantage is that a plurality of different types of coupling elements are required in the assembly of the frame structure. Another disadvantage is that the frame members used together with the connecting elements cannot be inserted into the coupling element if the frame member has been twisted prior to or in the course of assembling the frame structure. This makes it difficult to use frame members which have been used before or which have been exposed to the elements over a period of time.

SUMMARY OF THE INVENTION

An object of the invention is to circumvent the aforementioned difficulties and disadvantages. This is achieved by the fact that the connecting element according to the invention is provided with attachment means i.e. in the form of recesses or sleeves which extend in different directions and which are intended to receive frame members etc. The invention is characterized by the fact that two adjacent sleeves on the connecting element form therebetween an angle of substantially 120°, and by the fact that extending at 90° to said sleeves is a through-passing third sleeve which facilitates locking of two locking members. To be able to lock two frame members this third sleeve must in the first place be provided with at least two securing means therein i.e. in the form of holes for receiving nails, screws, bolts, bows and so on. Secondly, it is preferred that this third sleeve has a certain minimum total length assuring stable attachment of two frame members entering from opposite directions. Practical experiments have shown that said minimum total length ought to be half the circumference of the frame member plus or minus 10 percent depending on the quality of the lumber used in the frame member. One of the open ends of this third sleeve shall lie substantially flush with a pair of outermost coplanar faces of the other two sleeves, so that, when used as an endwall connecting element, said flush side of the connecting element can face said end wall. This enables the same connecting element to be used as a corner-nock coupling, as an eaves coupling and as a coupling for connecting together intermediate frames. The internal dimensions of the sleeves shall be greater than the cross-sectional dimensions of the frame members, so as to accommodate a predetermined degree of twisting the frame members of the frame structure. The roof of the frame structure slopes at substantially 30°, which means that only one type of connecting element need be used for constructing the entire frame structure. This is advantageous to both purchaser and manufacturer, and therefore also with respect to the economic factor.

An exemplary embodiment of the invention will now be described with reference to the accompanying drawing; in which

THE DRAWINGS

DESCRIPTION OF PREFERRED EMBODIMENTS

Figure 1:
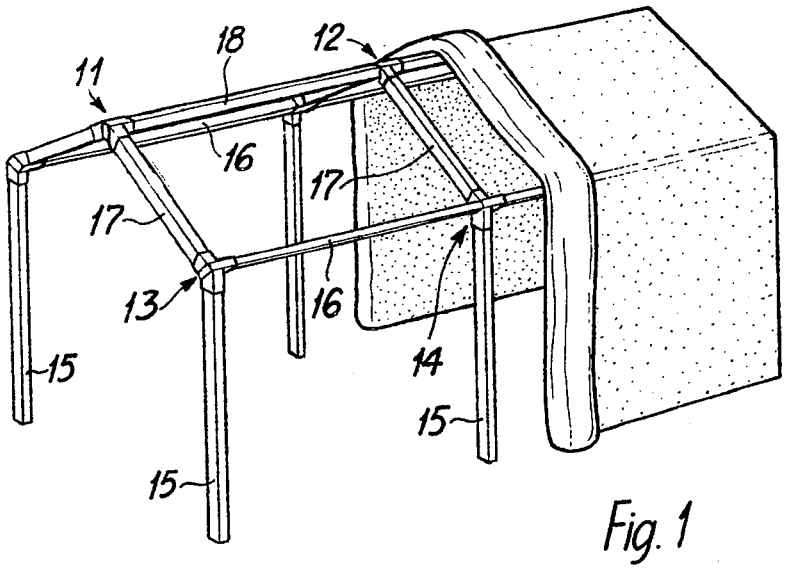
FIG. 1 shows a frame structure joined together by universal connecting elements according to the invention, said structure being suitable for housing boats etc.

Shown in FIG. 1 is a frame-structure which has been connected together by means of universal like-shaped elements 11, 12, 13 and 14, the frame structure being supported by posts 15. The frame members 16 are joined together by the connecting elements 13 and 14 to form a pole plate or wall plate while the frame members 18 are joined together by connecting elements 11 and 12 to form a ridge or arris beam. The frame members 17 extending between the ridge member and the pole plate or wall plate form the rafters of the frame stucture.

Figure 2:
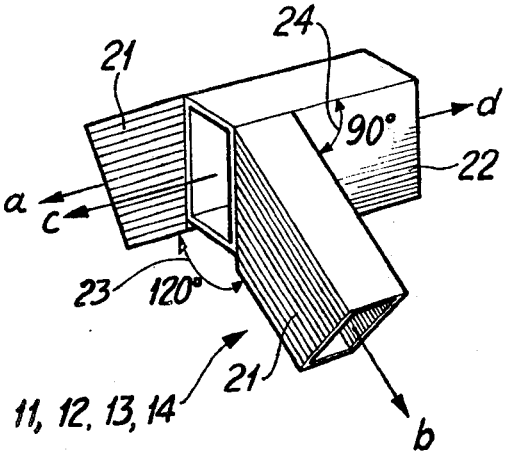
FIG. 2 is a perspective view of the universal connecting element to be used at all joints of the frame structure.
Figure 3:
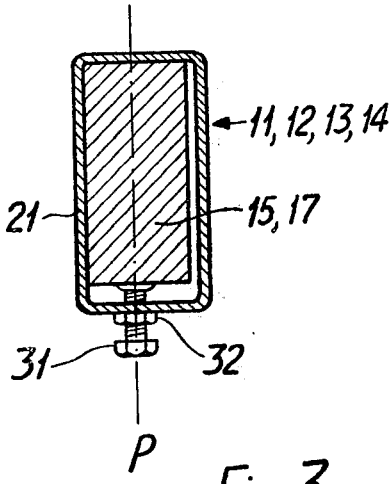
FIG. 3 is a cross-sectional view of FIG. 2.

The universal connecting elements shown in FIG. 2, is intended to couple together each of the joints of the frame structure, i.e. 11, 12, 13 and 14 in FIG. 1. The connecting element comprises two elongated sleeves 21 which are open at one end only and which are disposed adjacent one end of a third elongated sleeve 22. Sleeves 21 extend at an angle 23 of 120° to one another for receiving the rafters 17 and posts 15, and the third sleeve 22 which is open at both ends, extends in one direction only away from the plane defined by the forwardmost faces of sleeves 21 at an angle 24 of 90° to said plane for receiving the ridge members 18 and pole or wall plates 16. As shown in the drawings, one end of the third sleeve 22 is flush with said plane. The connecting element is provided with means for holding the frame members in each of the three sleeves, said means being shown in FIG. 3. Said means comprise preferably a locking screw 31 provided with a stop nut 32.

Frame structures according to FIG. 1, if they exceed a certain breath to the thickness of the frame members, should be provided with roof trusses. Furthermore, broader frame structures should be provided with a longitudinally extending roof member which extends parallel to the ridge member and the eaves board.

A further advantage afforded by this system is that, subsequent to cutting the frame members to the desired lengths, the frame structure can be preliminarily assembled and the cover placed thereon, whereafter the frame members can be adjusted in position in their respective sleeves so that the cover is tensioned and sits more securely on the structure.

Although the invention has been described with reference to an embodiment thereof, it is not limited thereto but can be modified within the scope of the accompanying claims.

I claim:

1. In a structural framework of the type comprising a plurality of separate, elongated frame members which are disposed in end to end relation to one another and which are oriented respectively in horizontal, vertical, and oblique directions to define different sections of said framework, the adjacent ends of said frame members being interconnected to one another by connecting elements at a plurality of junction points that are located respectively at the adjacent ends of groups of said frame members, said junction points and their associated connecting elements being disposed in spaced relation to one another throughout said framework, the improvement wherein the connecting elements provided at said junctions throughout said framework all have the same structural shape and configuration, each of said connecting elements consisting of first and second elongated, hollow sleeves which are interconnected to one another adjacent corresponding ends thereof, said first and second sleeves being open at the respective ends thereof remote from their interconnected ends for respectively receiving the ends of two of said frame members, said first and second sleeves being oriented at an angle of substantially 120° to one another and having a pair of outer faces which are coplanar with one another, and a third elongated, hollow sleeve located between the interconnected ends of said first and second sleeves and integral therewith for interconnecting said first and second sleeves to one another, said third sleeve being open at both ends thereof whereby said third sleeve is adapted to receive a further pair of said frame members at opposite ends of said third sleeve respectively, said elongated third sleeve being oriented at substantially 90° to said coplanar outer faces of said first and second sleeves, one of the open ends of said third sleeve being substantially flush with said coplanar outer faces of said first and second sleeves, and said elongated third sleeve extending in one direction only away from said coplanar faces of said first and second sleeves with the other open end of said third sleeve being positioned remote from said coplanar faces whereby said connecting element exhibits an asymmetrical configuration wherein said first and second sleeves are attached to and located adjacent one end of said elongated third sleeve.

2. The improvement of claim 1 wherein each of said hollow sleeves has a rectangular cross section, the width of the rectangular opening in each of said sleeves being greater than the width of the rectangular cross-section of a frame member which is to be inserted into said opening whereby said frame member can be inserted into said opening with a limited angle of twist.

3. The improvement of claim 2 wherein each of said sleeves includes means for securing a frame member in position within said sleeve.

4. The improvement of claim 3 wherein said third sleeve is provided with means for separately securing within said third sleeve each of two frame members that are inserted respectively into the opposite ends of said third sleeve.

5. The improvement of claim 1 wherein the length of said elongated third sleeve is equal to at least one-half the circumference of a frame member which is to be inserted into said third sleeve.

* * * * *